US011625005B2

(12) United States Patent
Nicolas et al.

(10) Patent No.: US 11,625,005 B2
(45) Date of Patent: Apr. 11, 2023

(54) HAND ROTATING AROUND TWO AXES

(71) Applicant: The Swatch Group Research and Development Ltd, Marin (CH)

(72) Inventors: Cedric Nicolas, Neuchatel (CH); Simon Springer, Bern (CH); Ahmad Odeh, Renens (CH); Michel Willemin, Preles (CH)

(73) Assignee: The Swatch Group Research and Development Ltd, Marin (CH)

( * ) Notice: Subject to any disclaimer, the term of this patent is extended or adjusted under 35 U.S.C. 154(b) by 311 days.

(21) Appl. No.: 16/991,276

(22) Filed: Aug. 12, 2020

(65) Prior Publication Data

US 2021/0080908 A1 Mar. 18, 2021

(30) Foreign Application Priority Data

Sep. 13, 2019 (EP) ..... 19197380

(51) Int. Cl.
*G04B 19/04* (2006.01)
*G04B 13/00* (2006.01)
*G04B 31/00* (2006.01)

(52) U.S. Cl.
CPC ..... *G04B 13/00* (2013.01); *G04B 19/04* (2013.01); *G04B 31/00* (2013.01)

(58) Field of Classification Search
CPC ..... G04B 31/00; G04B 19/04; G04B 13/00
See application file for complete search history.

(56) References Cited

U.S. PATENT DOCUMENTS 4,583,864 A * 4/1986 Graves ..... G04B 19/04 968/389
4,676,662 A * 6/1987 Sekido ..... G04B 19/04 968/142
4,693,613 A * 9/1987 Ritchie ..... G04B 45/043 368/228

(Continued)

FOREIGN PATENT DOCUMENTS

CH 702 422 A2 6/2011
DE 43 30 895 A1 3/1995

(Continued)

OTHER PUBLICATIONS

European Search Report dated Feb. 19, 2020 in European Application 19197380.9 filed Sep. 13, 2019 (with English Translation of Categories of Documents), 3 pages.

(Continued)

*Primary Examiner* — Sean Kayes
(74) *Attorney, Agent, or Firm* — Oblon, McClelland, Maier & Neustadt, L.L.P.

(57) ABSTRACT

A display mechanism of a watch including at least one indicator member and a drive member assembly. The indicator member is mounted to rotate about a first axis of rotation and is configured to indicate a time. The indicator member also has a second axis of rotation extending along the indicator member and a rotary element mounted to rotate about the second axis of rotation. The drive assembly includes a first drive member and a second drive member such that the first drive member drives the rotary element when it is moving about the first axis of rotation.

7 Claims, 3 Drawing Sheets

(56) References Cited

U.S. PATENT DOCUMENTS

| | | | | |
|---|---|---|---|---|
| 5,457,663 | A * | 10/1995 | Mejaski | G04B 19/26 368/29 |
| 2010/0322036 | A1 | 12/2010 | Crettex et al. | |
| 2015/0301504 | A1 | 10/2015 | Kim | |

FOREIGN PATENT DOCUMENTS

| | | | |
|---|---|---|---|
| EP | 1 705 535 | A1 | 9/2006 |
| JP | 1-193687 | A | 8/1989 |
| JP | 2000-105283 | A | 4/2000 |
| JP | 2010-507087 | A | 3/2010 |

OTHER PUBLICATIONS

Notice of the Reason for Refusal dated Aug. 31, 2021 in Japanese Patent Application No. 2020-144257 (with English language translation), 12 pages.

Combined Chinese Office Action and Search Report dated Jul. 5, 2021 in Chinese Patent Application No. 202010957675.0 (with partial English translation), 11 pages.

* cited by examiner

Fig. 5A
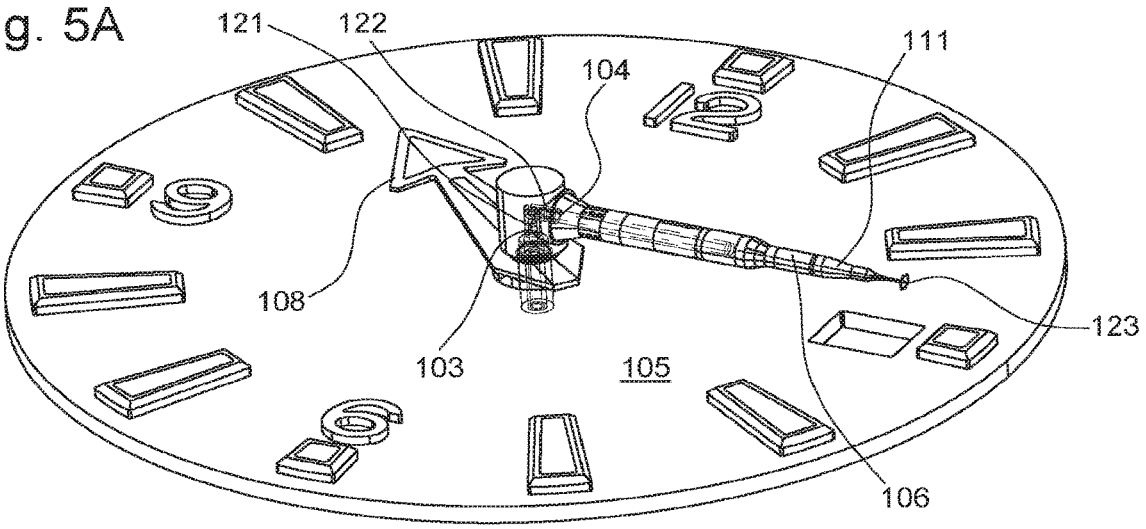
Fig. 5B
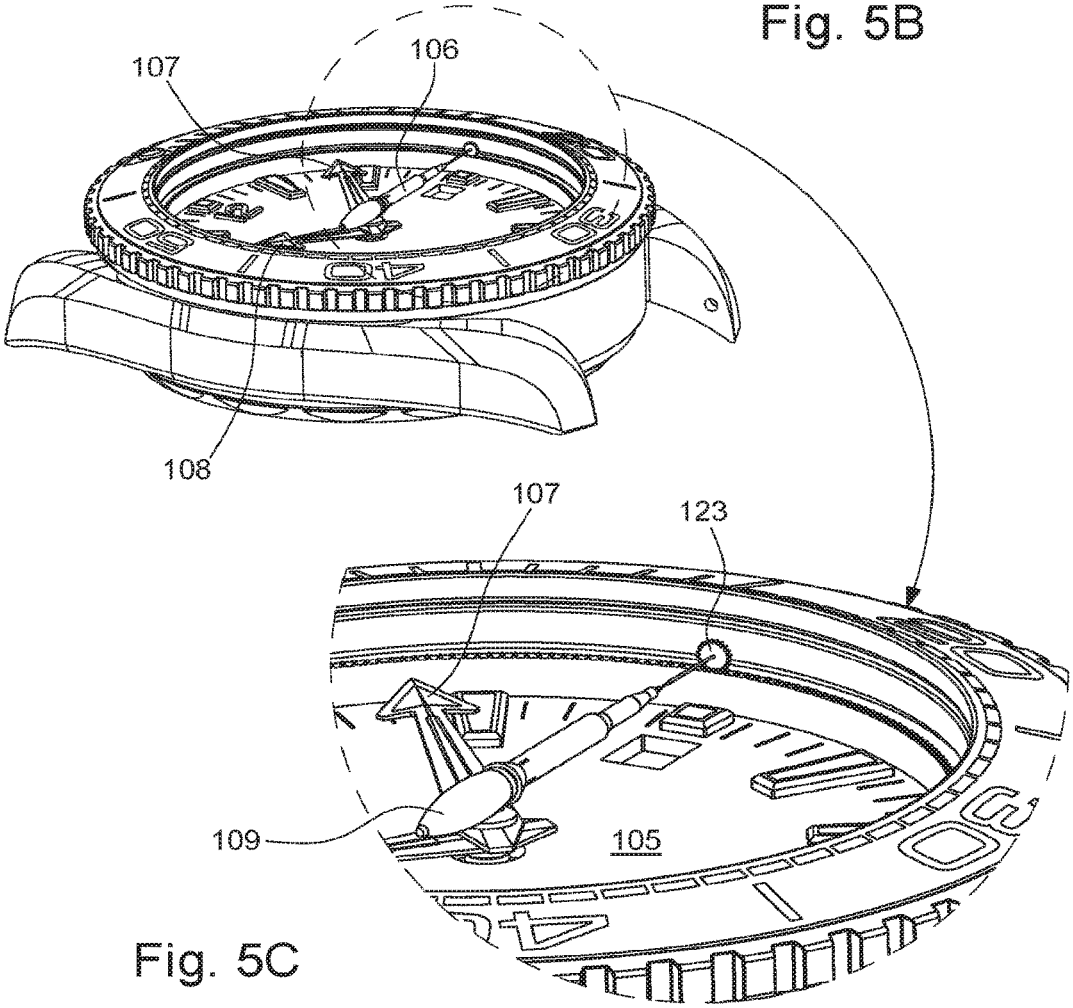
Fig. 5C

HAND ROTATING AROUND TWO AXES

CROSS-REFERENCE TO RELATED APPLICATION

This application claims priority to European Patent Application No. 19197380.9 filed on Sep. 13, 2019, the entire disclosure of which is hereby incorporated herein by reference.

TECHNICAL FIELD

The technical field of the present invention is that of horology, and more precisely that of display mechanisms.

TECHNICAL BACKGROUND

Display mechanisms are known from the prior art which have movements included in a plane and/or along an axis of freedom, which results in a restriction in the information provided to the user.

Indeed apart from an indication of the phase of the moon, the date and/or time, among others, no other indication or information can be provided simultaneously by the indicator to the user, in this case by the hand. In other words, the indicator cannot give two pieces of information at the same time.

SUMMARY OF THE INVENTION

The present invention proposes to fully or partially overcome these drawbacks via a display mechanism, in particular for a watch, and preferably of a watch, said display mechanism comprising at least:

one indicator member: said at least one indicator member being mounted to rotate about a first axis of rotation via a first part, and being configured to move relative to a dial so as to indicate a first piece of information; said at least one indicator member being mounted to rotate about a second axis of rotation intersecting said first axis of rotation and extending longitudinally along said at least one indicator member and comprising at least one rotary element mounted to rotate about said second axis of rotation via a second part so as to indicate a second piece of information;

one drive member assembly: said at least one drive assembly comprising at least one first drive member and at least one second drive member: said at least one second drive member being arranged on and/or in said at least one rotary element, and being driven by said at least one first drive member;

said at least one first drive member being configured to cooperate with said at least one second drive member in such a way as to drive said at least one rotary element in a rotational movement via said at least one second drive member, when said at least one indicator member is rotatable about said first axis of rotation and/or when said at least one drive member is rotatable about said first axis of rotation.

Through this arrangement, the indicator can rotate about two separate axes of said dial, of the second hand, the minute hand or the hour hand.

In other words, said at least one first drive member is respectively integral with said dial, a second hand, a minute hand or an hour hand.

Through this arrangement, when the hand is movable about the first axis, the rotary element above the dial and in particular the scale, the second hand, the minute hand or the hour hand is in rotation about the second axis.

According to one embodiment, said first part is a barrel and/or said second part is the second axis of rotation and extends longitudinally along said at least one indicator member.

Through this arrangement, the hand is movable about the first axis via a barrel, and/or said second part supports the rotary element.

According to one embodiment, said at least one drive member assembly is at least one gear assembly comprising at least one first gear member and at least one second gear member, at least one micro-bearing assembly comprising at least one first micro-bearing and at least one second micro-bearing, and/or at least one bearing assembly comprising at least one first bearing and at least one second bearing.

According to one embodiment, said at least one rotary element is a counterweight of said at least one indicator member, a counterweight of a second hand, a counterweight of a minute hand or a counterweight of an hour hand and wherein said at least one indicator member is a body of a second hand, a body of a minute hand or a body of an hour hand.

Through this arrangement the counterweight of the indicator member can rotate about two separate axes.

According to one embodiment, said at least one indicator member is a second hand, a minute hand or an hour hand.

According to one embodiment, said second axis of rotation is coplanar with said dial and said first axis of rotation is in a different plane from said second axis of rotation.

According to one embodiment, said second axis of rotation is perpendicular to said first axis of rotation.

According to one embodiment, said at least one drive member assembly comprises a universal joint and at least one third drive member; said at least one third drive member being arranged at the end of said rotary element so as to drive said second hand, said minute hand or said hour hand about the first axis of rotation.

The embodiments and the variants mentioned above can be taken in isolation or in any possible technical combination.

The present invention will be clearly understood and its advantages will also emerge in light of the following description, given by way of non-limiting example only and with reference to the attached figures, in which identical reference signs correspond to structurally and/or functionally identical or similar elements.

BRIEF DESCRIPTION OF THE FIGURES

The invention will be described below in more detail using the attached drawings, given by way of example and in no way limiting, in which:

FIGS. 5A, 5B and 5C present the display mechanism of a watch with a universal joint according to one embodiment as well as its enlargement.

DETAILED DESCRIPTION OF THE INVENTION

Figure 1:
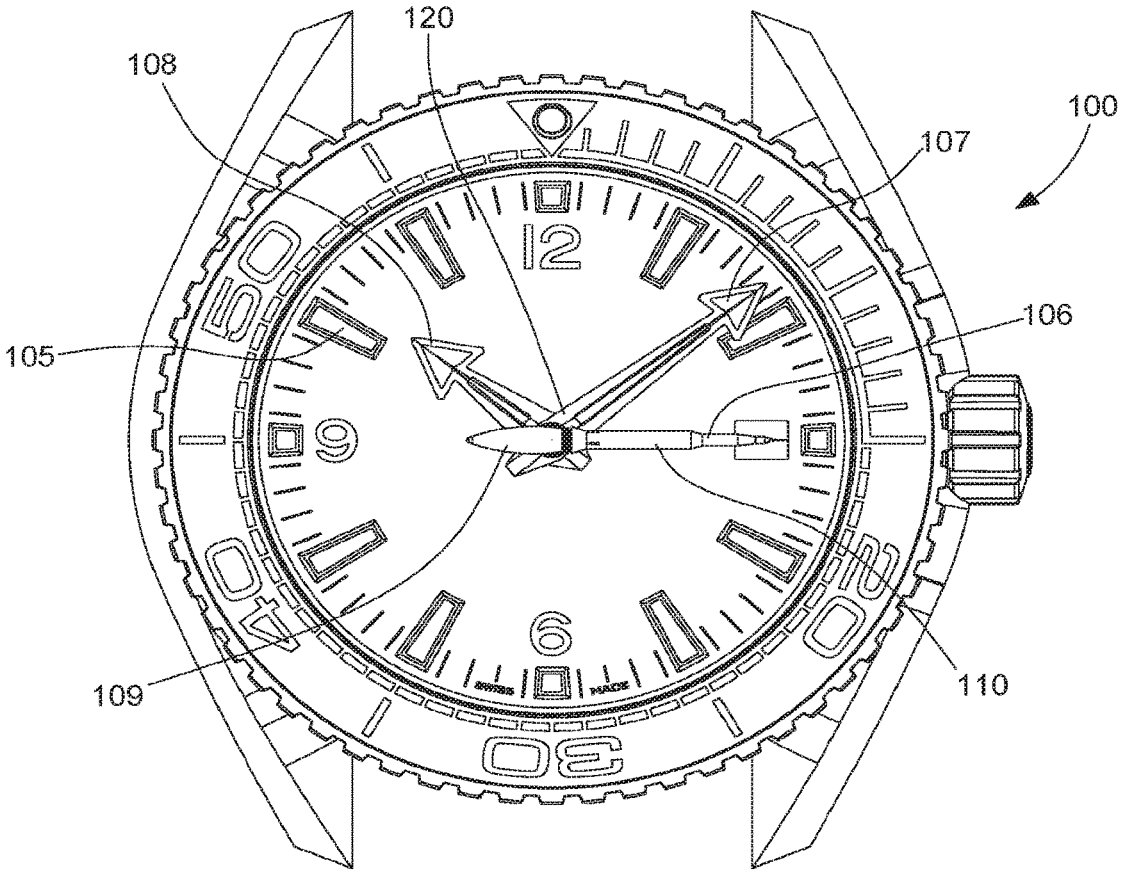
FIG. 1 shows a watch comprising the display mechanism of a watch according to one embodiment.

The present invention, illustrated in FIG. 1, is in the form of a display mechanism 100 for a watch and more exactly the display mechanism 100 of a watch.

As can be seen in FIG. 1, this display mechanism 100 may comprise at least one indicator member 110 and at least one drive mechanism assembly 120.

Figure 2:
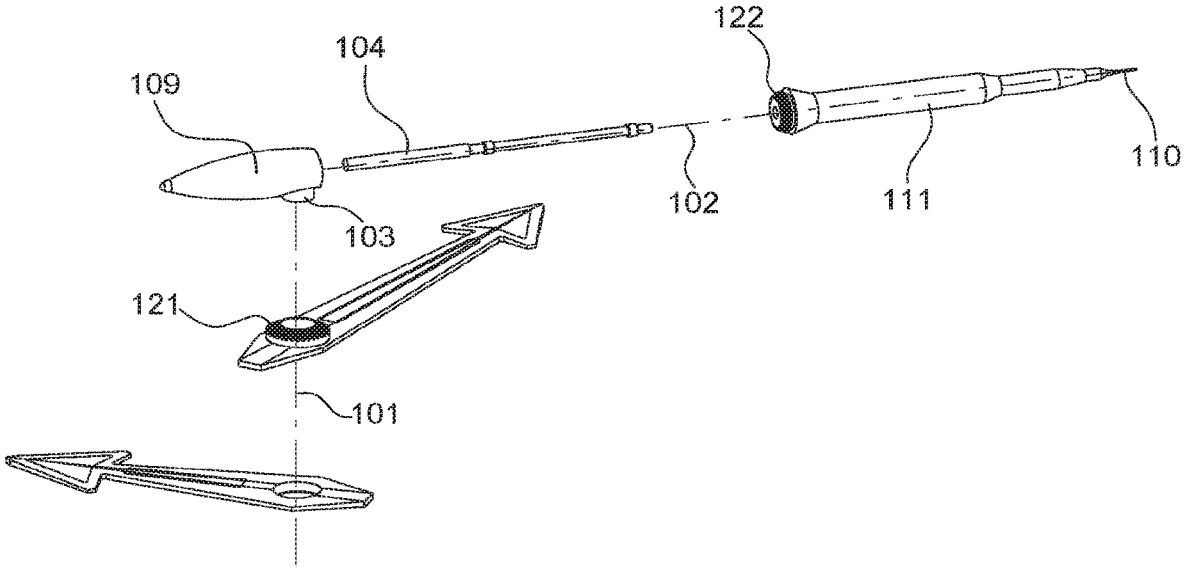
FIG. 2 shows an exploded view of a display mechanism of a watch according to one embodiment.

The indicator member 110 may be mounted to rotate about a first axis of rotation 101 via a first part 103 which can act as a barrel 103, according to the embodiments, as can be seen in FIG. 2.

This first part 103, or this barrel, moves with respect to a scale and preferably with respect to a dial 105 on which can be represented, for example, a scale representing the phases of the moon, a date and/or a time, in other words a scale representing the hours, minutes, seconds or any smaller graduations of a second such as a hundredth or other divisions of a second. Furthermore, this scale can represent the power reserve, tachometer, day of the week, month of the year, sign of the zodiac, temperature, pressure, altitude, depth, weather forecast, time zone or any other indication relevant to the user.

The indicator member 110 can also be rotatable about a second axis of rotation 102. This second axis of rotation 102 can be intersecting and/or perpendicular with the first axis of rotation 101, and, according to one embodiment, this second axis of rotation 102 can be coplanar with the scale, i.e. the dial 105, and the first axis of rotation 101 can be in a different plane to that of the second axis of rotation 102.

This second axis of rotation 102 extends longitudinally along the indicator member 110 and can be materialised by a second part 104 which extends longitudinally along the indicator member 110. The indicator member 110 can also be composed of a rotary element 111 which can be mounted to rotate about the second axis of rotation 102 via the second part 104.

As mentioned above, the display mechanism can also comprise a drive member assembly 120. This drive assembly comprises a first drive member 121 and a second drive member 122, as can be seen in FIGS. 2 to 5A, 5B and 5C.

The second drive member 122 can be arranged on and/or in said at least one rotary element 111, and can be driven by the first drive member 121. The latter, in other words the first drive member 121, can be configured to cooperate with the second drive member 122 in such a way as to drive the rotary element 111 in a rotary movement about the second axis of rotation 102.

Figure 3:
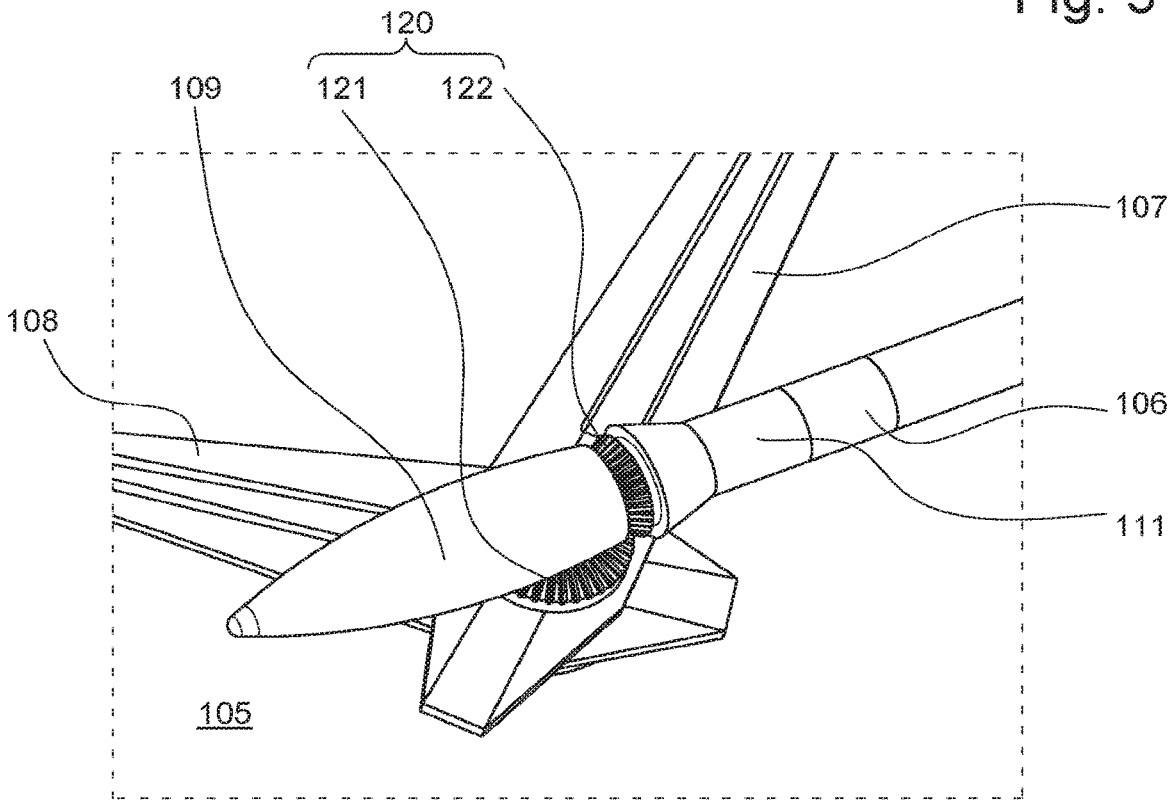
FIG. 3 shows an enlargement of the mechanism according to one embodiment.
Figure 4:
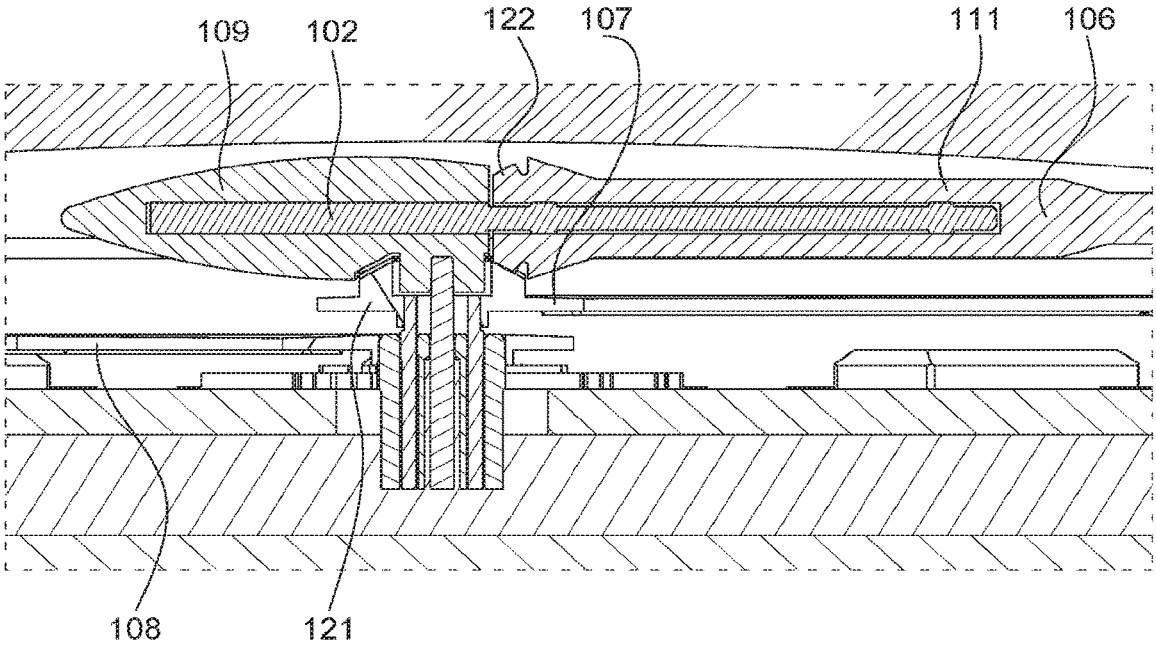
FIG. 4 shows a sectional view of the display mechanism according to one embodiment.

Indeed, the view of the mechanism in FIG. 2 and the enlargement of FIG. 3 clearly show that the indicator member 110 can be rotatable about said first axis of rotation 101, the second drive member 122 can be meshed by the first drive member 121 which rotates the rotary element 111 about the second axis of rotation 102 when the indicator member 110 can rotate about the first axis of rotation 101. Thus the rotary element 111 can comprise a piece of information which will be gradually revealed as the indicator member 110 turns about the first axis of rotation 101. Obviously, the rotary element 111 can also represent an object, a sculpture and/or a miniature of an object comprising a second piece of information. Thus, the hand of the dial, in other words the hand which belongs to a dial with a scale or an indication, can be rotatable about two very distinct axes, and indicate two equally clearly distinct pieces of information. The sectional view shown in FIG. 4, shows an example of the location of the first drive member 121 and the second drive member 122.

The speed of the rotary element 111 about the second axis of rotation 102 can thus be determined by the location of the first drive member 121 and the second drive member 122 on the one hand, and on the other hand by the ratio, for example gearing, between the first drive member 121 and the second drive member 122. For example, the first drive member 121 can be integral with the scale, as mentioned above, of the dial 105, the second hand 106, the minute hand 107 or the hour hand 108 and/or the second drive member 122 can be integral with the hour hand 108, the minute hand 107 or the second hand 106, depending on whether the indicator member 110 is the second hand 106, the minute hand 107 or the hour hand 108.

Furthermore, depending on where the rotary element can be placed, a counterweight 109 may be necessary in order to counterbalance the imbalance generated by the weight of the second hand 106, the minute hand 107 or the hour hand 108 when the indicator member 110 is a second hand 106, a minute hand 107 or an hour hand 108 respectively.

According to one embodiment, the rotary element can be placed on the counter weight 109 of the second hand 106, of the minute hand 107 or of the hour and 108. Consequently, the counterweight 109 of the hand can be rotatable about the first axis of rotation 101 and about the second axis of rotation 102.

The drive member assembly 120, mentioned above, can be in the form of a gear assembly comprising a first gear member 121 and a second gear member 122, a micro-bearing assembly comprising a first micro-bearing and a second micro-bearing, and/or a bearing assembly comprising a first bearing and a second bearing. In certain embodiments, the drive member assembly 120 can be a universal joint, as illustrated in FIGS. 5A, 5B and 5C.

In this case, contrary to the preceding paragraph, it is the first drive member 121 which is rotatable about the first axis of rotation 101 rather than the indicator member 110. Indeed, when the first part 103 of the universal joint turns about the first axis of rotation 101, the second part 104, in other words the rotary element 111, turns about the second axis of rotation 102 without being in rotation about the first axis of rotation 101.

The drive member assembly can also comprise, in this embodiment, at least a third drive member 123, which can be arranged at the end of the rotary element 110 for example, as can be seen in FIG. 5A, so as to drive said second hand 106, said minute hand 107 or said hour hand 108 about the first axis of rotation 101, while the universal joint rotates the rotary element 110 about the second axis of rotation 102.

In other words, the rotary element 110 only moves about the second axis of rotation 102. If it is desired to have an additional movement, it may be necessary to add at least a third drive member 123, so that when the first drive 121 is rotatable about the first axis of rotation 101, the second drive member 122, and by extension the rotary element 111 according to one embodiment, is in rotation about the second axis of rotation 102, and the third drive member 123 rotates the rotary element 111 about the first axis of rotation 101. Hence, the rotary element 111 may comprise a second piece of information which will be gradually revealed as the indicator member 110 turns about the first axis of rotation 101 and indicates a first piece of information.

The invention claimed is:

1. A display mechanism for a watch, said display mechanism comprising at least:

at least one indicator member being mounted to rotate about a first axis of rotation via a first part, and being configured to move relative to a dial so as to indicate a first piece of information; said at least one indicator member being mounted to rotate about a second axis of rotation intersecting said first axis of rotation and extending longitudinally along said at least one indicator member and comprising at least one rotary element mounted to rotate about said second axis of rotation via a second part so as to indicate at least one second piece of information;

at least one drive member assembly comprising at least one first drive member and at least one second drive member, said at least one second drive member being arranged on or in said at least one rotary element at a first end of the rotary element, and being driven by said at least one first drive member;

said at least one first drive member being configured to cooperate and directly engage with said at least one second drive member in such a way as to drive said at least one rotary element in a rotational movement via said at least one second drive member, when said at least one indicator member is rotatable about said first axis of rotation and/or when said at least one drive member is rotatable about said first axis of rotation, wherein said at least one indicator member is a second hand, a minute hand or an hour hand, and wherein said at least one drive member assembly comprises a universal joint and at least one third drive member, said at least one third drive member being arranged at a second end of the rotary element opposite to the first end.

2. The display mechanism according to claim 1, wherein said at least one first drive member is respectively integral with said dial, the second hand, the minute hand or the hour hand.

3. The display mechanism according to claim 1, wherein said first part is a barrel and/or said second part is the second axis of rotation and extends longitudinally along said at least one indicator member.

4. The display mechanism according to claim 1, wherein said at least one drive member assembly is at least one gear assembly comprising at least one first gear member and at least one second gear member, at least one micro-bearing assembly comprising at least one first micro-bearing and at least one second micro-bearing, and/or at least one bearing assembly comprising at least one first bearing and at least one second bearing.

5. The display mechanism according to claim 1, wherein said at least one rotary element is a counterweight of a second hand, a counterweight of a minute hand or a counterweight of an hour hand and wherein said at least one indicator member is said second hand, said minute hand or said hour hand.

6. The display mechanism according to claim 1, wherein said second axis of rotation is coplanar with said dial and said first axis of rotation is in a different plane from said second axis of rotation.

7. The display mechanism according to claim 1, wherein said at least one third drive member drives said second hand, said minute hand or said hour hand about the first axis of rotation.

* * * * *